US011850650B2

(12) United States Patent
Wilhelm et al.

(10) Patent No.: US 11,850,650 B2
(45) Date of Patent: Dec. 26, 2023

(54) TOOL AND METHOD FOR PROCESSING PLATE-SHAPED WORKPIECES, IN PARTICULAR METAL SHEETS

(71) Applicant: TRUMPF Werkzeugmaschinen SE + Co. KG, Ditzingen (DE)

(72) Inventors: Markus Wilhelm, Gerlingen (DE); Takeshi Abiko, Ditzingen (DE)

(73) Assignee: TRUMPF Werkzeugmaschinen SE + Co. KG, Ditzingen (DE)

( * ) Notice: Subject to any disclaimer, the term of this patent is extended or adjusted under 35 U.S.C. 154(b) by 0 days.

(21) Appl. No.: 17/582,189

(22) Filed: Jan. 24, 2022

(65) Prior Publication Data

US 2022/0143666 A1 May 12, 2022

Related U.S. Application Data

(63) Continuation of application No. PCT/EP2020/070482, filed on Jul. 20, 2020.

(30) Foreign Application Priority Data

Jul. 23, 2019 (DE) ..... 10 2019 119 848.8

(51) Int. Cl.
*B21D 5/04* (2006.01)
*B21D 5/16* (2006.01)
*B21D 28/26* (2006.01)

(52) U.S. Cl.
CPC ..... *B21D 5/045* (2013.01); *B21D 5/16* (2013.01); *B21D 28/265* (2013.01)

(58) Field of Classification Search
CPC . B21D 5/01; B21D 5/04; B21D 5/047; B21D 5/16; B21D 39/02; B21D 39/021
See application file for complete search history.

(56) References Cited

U.S. PATENT DOCUMENTS

| | | | |
|---|---|---|---|
| 8,375,763 | B2 | 2/2013 | Bauer et al. |
| 11,478,835 | B2 | 10/2022 | Wilhelm et al. |
| 2019/0299272 | A1 | 10/2019 | Ockenfuss et al. |

FOREIGN PATENT DOCUMENTS

| | | | |
|---|---|---|---|
| CN | 101610857 | A | 12/2009 |
| CN | 103990709 | A | 8/2014 |

(Continued)

OTHER PUBLICATIONS

Machine Translation of JP 07032067A (Year: 1995).*
Machine Translation of JP 2004098128A (Year: 2004).*

*Primary Examiner* — Debra M Sullivan
(74) *Attorney, Agent, or Firm* — Laurence A. Greenberg; Werner H. Stemer; Ralph E. Locher

(57) ABSTRACT

A tool and method for processing plate-shaped workpieces, such as metal sheets. An upper tool and a lower tool are moved toward one another with a workpiece arranged in between. The upper tool carries a processing tool on a main body opposite a clamping shank. The lower tool has a main body and bearing surface for the workpiece with an opening in the bearing surface. The processing tool of the upper tool has a bending edge and the main body of the lower tool has a counterpart bending edge which is positioned in the opening of the bearing surface. The bearing surface being displaceable relative to the counterpart bending edge such that the counterpart bending edge projects from the opening in the bearing surface.

16 Claims, 8 Drawing Sheets

(56) References Cited

FOREIGN PATENT DOCUMENTS

| | | | | |
|---|---|---|---|---|
| CN | 109789466 | A | | 5/2019 |
| DE | 20018936 | U1 | | 1/2001 |
| DE | 10223637 | A1 | | 12/2003 |
| DE | 102016119435 | A1 | | 4/2018 |
| DE | 102016119457 | A1 | | 4/2018 |
| EP | 0383176 | A1 | | 8/1990 |
| JP | 07032067 | A | | 2/1995 |
| JP | 07032067 | A | * | 3/1995 |
| JP | H0733413 | U | | 6/1995 |
| JP | 2000024716 | A | | 1/2000 |
| JP | 2004098128 | A | * | 4/2004 |
| JP | 2004098128 | A | | 4/2004 |

* cited by examiner

TOOL AND METHOD FOR PROCESSING PLATE-SHAPED WORKPIECES, IN PARTICULAR METAL SHEETS

CROSS-REFERENCE TO RELATED APPLICATION

This application is a continuation, under 35 U.S.C. § 120, of copending International Patent Application PCT/EP2020/070482, filed Jul. 20, 2020, which designated the United States; this application also claims the priority, under 35 U.S.C. § 119, of German Patent Application DE 10 2019 119 848.8, filed Jul. 23, 2019; the prior applications are herewith incorporated by reference in their entirety.

FIELD AND BACKGROUND OF THE INVENTION

The invention relates to a tool and to a method for processing plate-like workpieces, in particular metal sheets.

A machine tool is known from our commonly assigned German published patent application DE 10 2016 119 435 A1. The machine tool is configured for processing plate-shaped or plate-like workpieces, in particular metal sheets. The tools are actuated by the machine tool for the purposes of stamping and punching. The tool comprises an upper tool, which is movable by means of a stroke drive apparatus along a stroke axis in the direction of a workpiece for processing and in the opposite direction and is displaceable by means of a drive arrangement along the upper positioning axis. Furthermore, a lower tool is provided which is aligned with the upper tool and which is movable by means of a stroke drive apparatus along a lower stroke axis in the direction of the upper tool and is positionable along a lower positioning axis which is oriented perpendicular to the position axis of the upper tool. The drive arrangements are actuated, in order to move the upper and lower tool, by means of a controller. The upper tool comprises a processing tool that is inclined relative to a positioning axis of the upper tool. Two cutting edges oriented parallel to one another are provided on the processing tool in order, for example, to cut a sheet-metal tab that has been bent up at an angle or to produce a side surface oriented obliquely with respect to the plane of the plate-like workpiece.

Our commonly assigned German published patent application DE 10 2016 119 457 A1 furthermore discloses a machine tool of said type. To produce bends or angled bends on a workpiece part of a plate-like workpiece, use is made of a tool that is composed of an upper tool and a lower tool. The upper tool comprises a clamping shank and a main body and a processing tool, which comprises a bending edge. Said processing tool is provided on the main body so as to be situated opposite the clamping shank. Here, the bending edge of the processing tool preferably lies outside a projection area of the main body of the upper tool, which projection area is formed perpendicular to the position axis and as viewed in the stroke direction. The lower tool comprises a main body and a bearing block arranged rotatably thereon, on which bearing block a partially cylindrical angled-bend-forming bolt is mounted in a corresponding recess and about an axis of rotation. Here, the axis of rotation of the angled-bend-forming bolt extends parallel to the bending axis. To produce an angled bend, the bending edge of the upper tool is aligned with the angled-bend-forming bolt. By means of a purely displacement movement of the bending edge in a stroke direction along the position axis, 90° angled bending is made possible, the angled-bend-forming bolt performing a rotational movement in order to set the workpiece part upright in relation to the bending edge.

SUMMARY OF THE INVENTION

It is accordingly an object of the invention to provide a machine tool and a related method which overcome a variety disadvantages associated with the heretofore-known devices and methods of this general type and which provides for a tool and a method for processing plate-shaped workpieces, by means of which increased flexibility in the processing of the workpieces, in particular for the introduction of a bend contour, is made possible.

With the above and other objects in view there is provided, in accordance with the invention, a tool for processing plate-shaped workpieces, such as sheet metal. The tool comprises:

- an upper tool and a lower tool movably disposed toward one another for processing a workpiece arranged between said upper and lower tools;
- said upper tool having a clamping shank and a main body, arranged on a common position axis, and a processing tool mounted to said main body opposite said clamping shank;
- said processing tool of said upper tool having at least one bending edge;
- said lower tool having a main body with a bearing surface for the workpiece and an opening formed within said bearing surface;
- said main body of said lower tool having at least one counterpart bending edge fixedly formed thereon and positioned in said opening formed in said bearing surface; and
- said bearing surface being displaceable relative to said counterpart bending edge to enable said counterpart bending edge to protrude from said opening formed in said bearing surface.

In other words, the objects of the invention are achieved by a tool for processing plate-like workpieces, in the case of which the upper tool comprises a processing tool with at least one bending edge and the lower tool comprises a main body with at least one counterpart bending edge provided fixedly on the main body, the main body comprising a bearing surface with a cutout that surrounds the counterpart bending edge, and the bearing surface being displaceable relative to the counterpart bending edge such that, when load is exerted on the bearing surface, the counterpart bending edge, in the cutout, projects relative to the bearing surface. This tool allows different bend contours to be produced. By means of this tool, the workpiece part is bent upward relative to the plate-like workpiece. So-called pivoting bending can be generated. Here, different bend contours can be realized, the course of which also differs from a 90° angle bend.

Angled bends of 90°, or overbending, can also be produced on a workpiece part by means of such a tool. A folded edge or a fold can also be generated. Furthermore, such a tool allows so-called endless bending, or bending with multiple incremental bending steps, in order to produce greater bend radii several times greater than a radius of the bending edge and/or counterpart bending edge.

Preferably, the bearing surface and a ram surface of the counterpart bending edge, which is assigned to the opening of the bearing surface on the lower tool, are aligned flush with the bearing surface in an initial position. Straightforward and disruption-free positioning of an unprocessed plate-like workpiece, or at least partially plate-like workpiece, on the lower tool can thus be made possible.

The bending edge of the upper tool and the counterpart bending edge of the lower tool are preferably of equal length. In this way, bending or angled bending which takes place in accordance with the length of the bending edge and counterpart bending edge can be made possible by means of one stroke. It is also possible for the bending edge on the upper tool to be configured to be shorter than the counterpart bending edge. This can be advantageous in particular in the case of an incremental bending of plate-like workpieces.

Furthermore, the bending edge of the upper tool and the counterpart bending edge of the lower tool preferably subsequently each have a surface which is inclined relative to the ram surface and which is oriented at an angle of less than 90° with respect to the ram surface. In this way, both the bending edge and the counterpart bending edge have an undercut as viewed in relation to the ram surface, whereby the processing range for the introduction of a bend contour is increased.

According to a first embodiment, the upper tool may have a processing tool with a bending edge which lies within a projection area which is formed perpendicular to the position axis and as viewed in the stroke direction. The bending edge advantageously crosses the positioning axis. Here, in the case of 90° angled bending, the length of the limb that is bent at an angle on the workpiece part is limited by the spacing of the ram surface of the processing tool to the main body. Alternatively, the bending edge of the processing tool on the upper tool may be provided outside the projection area of the main body, the projection area being formed perpendicular to the position axis and, as viewed in the stroke direction, by the periphery of the main body. In this way, the length for an angled part of the workpiece part is considerably increased, because that section of the workpiece part which is oriented upward as a result of the pivoting bending or the angled bending can be moved past the main body of the upper tool. If the width of the workpiece for processing corresponds to the length of the bending edge, a pivoting bending movement or angled bending can extend as far as a tool receptacle which is only partially surrounded by a deflecting collar, which deflecting collar is oriented in the direction of the bending edge of the tool and is interrupted in said region.

With the above and other objects in view there is also provided, in accordance with the invention, a method for processing a plate-shaped workpiece, such as a sheet metal sheet. The method comprising:

providing an upper tool, which is movable by a stroke drive device along a stroke axis in a Z direction and in a direction of the workpiece for processing by the upper tool and in an opposite direction, and which is positionable along an upper positioning axis running perpendicular to the stroke axis in a Y direction, and moving the upper tool along the upper positioning direction by a drive arrangement;

providing a lower tool, which is aligned with the upper tool and is positionable along a lower positioning axis which points in the Y direction and which is oriented perpendicular to the stroke axis of the upper tool, and moving the lower tool along the lower positioning axis by a drive arrangement;

actuating the drive arrangements by a controller for moving the upper and lower tools relative to one another;

providing a tool according to claim 1 for processing the workpiece, and positioning a workpiece part of the plate-shaped workpiece relative to the bearing surface of the lower tool;

aligning the bending edge of the upper tool and the counterpart bending edge of the lower tool with one another;

transferring at least one of the bending edge or the counterpart bending edge, by way of a stroke movement in the Z direction, into a first working position in which the bending edge is positioned, as viewed in the Z direction, with a spacing equal to a thickness of the workpiece, and as viewed in the Y direction, at least with a spacing of the thickness of the workpiece, relative to the counterpart bending edge; and controlling a subsequent displacement movement of the bending edge and the counterpart bending edge by moving at least one of the counterpart bending edge or the bending edge past one another by superposition of the displacement movements in the Z direction and in the Y direction.

In other words, the objects of the invention are achieved by means of a method for processing plate-like workpieces, in which a tool according to any one of the embodiments described above is used, and the bending edge on the upper tool and the counterpart bending edge on the lower tool are, prior to the commencement of a pivoting bending process, transferred into a first working position in which the bending edge is positioned, as viewed in a Z direction, with the spacing of the thickness of the workpiece to the counterpart bending edge, and as viewed in a Y direction, at least with the spacing of the thickness of the workpiece to the counterpart bending edge, and the bending edge and/or the counterpart bending edge are subsequently set in a displacement movement, by means of which the bending edge and the counterpart bending edge are moved past one another until an end position for the removal of the workpiece part is reached. Thus, with progressive displacement movement from the first working position to the end position, the counterpart bending edge on the lower tool projects relative to the bearing surface in order to perform the pivoting bending movement. As a result of the superposition of a displacement movement in the Z direction and in the Y direction, targeted control of the tool to introduce a bend contour can be made possible. A large number of different bend contours can be introduced by means of this superposed displacement movement. In particular, pivoting bending can be implemented.

It is preferably the case that, during a pivoting bending process, the counterpart bending edge is static and the bending edge is driven on a curved path. In this way, proceeding from the first working position, the upper tool is driven with a superposed displacement movement in the Z and Y directions, such that a curved path is generated, wherein, in particular toward the end of the pivoting bending step, the advancing movement in the Z direction decreases and the displacement movement in the Y direction increases. Alternatively, the bending edge may be static and the counterpart bending edge may be driven on a curved path. An analogous description to that given in the case of the interchanged driving of the displacement movement of the bending edge relative to the counterpart bending edge applies here.

According to a further alternative embodiment of the method, the bending edge and the counterpart bending edge are both transferred from the first working position into an end position by being driven on a curved path. This also constitutes an embodiment for introducing bend contours.

A further preferred embodiment of the method provides that the displacement movement of the bending edge and/or that of the counterpart bending edge are driven several times in succession for incremental bending, each bending step comprising a bend angle on the workpiece part of less than 90°. In this way, it is possible to realize bend radii of different sizes that are all larger than a bend radius of the bending edge and/or counterpart bending edge.

A further advantageous embodiment of the method provides that a helical contour is introduced into a workpiece which has a Y-shaped cut layout. The Y-shaped cut layout of the workpiece has two arms which are positioned in a V shape with respect to one another. The helical contour can be formed through the introduction of multiple bending edges into the respective arm. The helical contour can have a greater or lesser diameter in a manner dependent on the bend angle.

A further advantageous embodiment of the method provides that, if a width of the workpiece part is greater than the length of the counterpart bending edge, multiple bending steps are introduced into the workpiece part in succession and along the same bending edge. In this way, by means of multiple strokes between the upper and the lower tool, a bending edge is generated which is greater than the length of the counterpart bending edge and/or of the bending edge.

A further advantageous embodiment for introducing a bending edge into the workpiece part, which bending edge is longer than the counterpart bending edge or bending edge of the tool, provides that the sequence of the bending steps of a subsequent bending edge in the workpiece is configured to be different in relation to the preceding bending edge of the workpiece. For example, the first stroke for a subsequent bending edge may be provided so as to be laterally offset by one position in relation to a first stroke of the bending step in the case of the preceding bending edge in the workpiece. A uniform contour can thus be introduced. This is advantageous in particular if relatively large bend radii are introduced by incremental bending.

Other features which are considered as characteristic for the invention are set forth in the appended claims.

Although the invention is illustrated and described herein as embodied in a tool and a method for processing plate-shaped workpieces, in particular metal sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
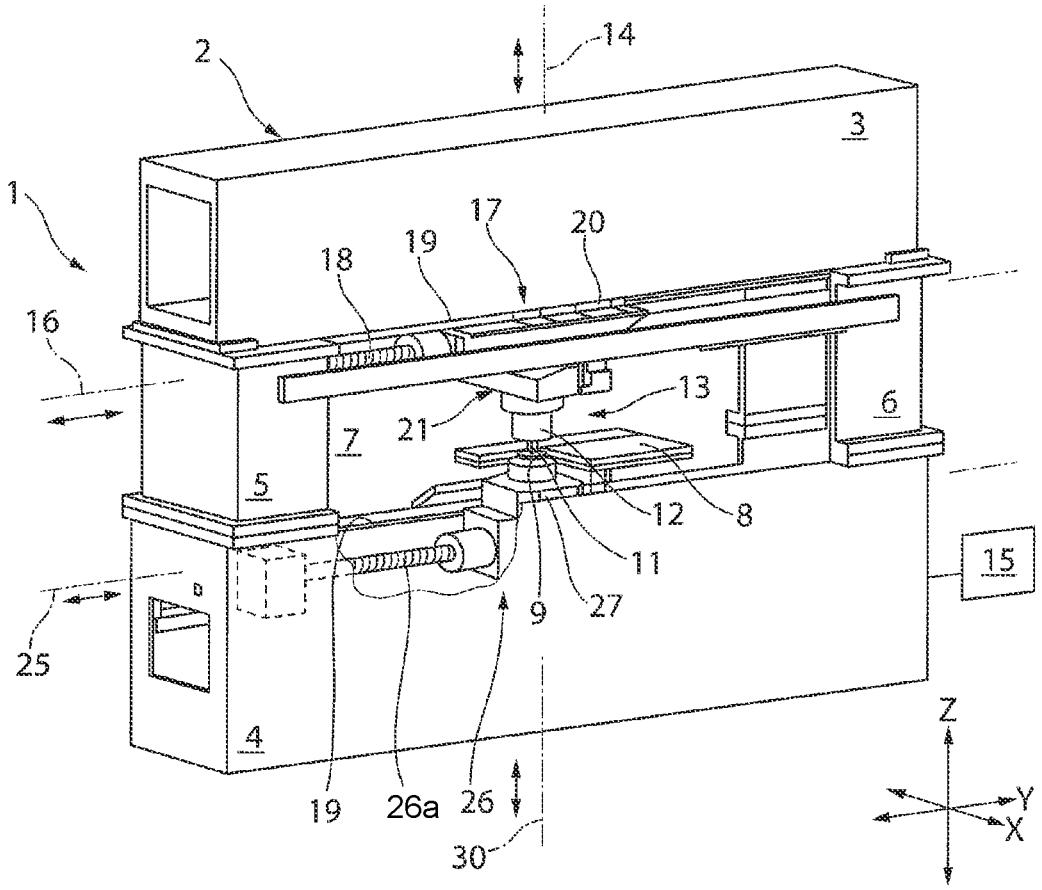
FIG. 1 shows a perspective view of a machine tool.

FIG. 1 illustrates a machine tool 1 that is configured as a punching and bending machine. The machine tool 1 comprises a load-bearing structure with a closed machine frame 2. Said machine frame comprises two horizontal frame members 3, 4 and two vertical frame members 5 and 6. The machine frame 2 encloses a frame interior space 7, which forms the working region of the machine tool 1 with an upper tool 11 and a lower tool 9.

The machine tool 1 serves for the processing of plate-shaped or plate-like workpieces 10, which for the sake of simplicity are not illustrated in FIG. 1, and which for processing purposes are arranged in the frame interior space 7. A workpiece 10 for processing is placed onto a workpiece support 8 that is provided in the frame interior space 7. The lower tool 9 is mounted, in an aperture of the workpiece support 8, on the lower horizontal frame member 4 of the machine frame 2.

The upper tool 11 is fixed in a tool receptacle at a lower end of a plunger 12. The plunger 12 is part of a stroke drive apparatus 13, by means of which the upper tool 11 can be moved in a stroke direction along a stroke axis 14. The stroke axis 14 runs in the direction of the Z axis of the coordinate system in a numerical controller 15, indicated in FIG. 1, of the machine tool 1. Perpendicularly with respect to the stroke axis 14, the stroke drive apparatus 13 can be moved along a positioning axis 16 in the direction of the double arrow. The positioning axis 16 runs in the direction of the Y direction of the coordinate system of the numerical controller 15. The stroke drive apparatus 13, which receives the upper tool 11, is moved along the positioning axis 16 by means of a motor drive 17.

The movement of the plunger 12 along the stroke axis 14 and the positioning of the stroke drive apparatus 13 along the positioning axis 16 are performed by means of a motor drive arrangement 17, in particular spindle drive arrangement, with a drive spindle 18 which runs in the direction of the positioning axis 16 and which is fixedly connected to the machine frame 2. During movements along the positioning axis 16, the stroke drive apparatus 13 is guided on three guide rails 19 of the upper frame member 3, of which two guide rails 19 can be seen in FIG. 1. The one remaining guide rail 19 runs parallel to the visible guide rail 19 and is spaced apart from the latter in the direction of the X axis of the coordinate system of the numerical controller 15. Guide shoes 20 of the stroke drive apparatus 13 run on the guide rails 19. The mutual engagement of the guide rail 19 and of the guide shoes 20 is such that this connection between the guide rails 19 and the guide shoes 20 can also accommodate a load acting in a vertical direction. The stroke apparatus 13 is accordingly suspended on the machine frame 2 by means of the guide shoes 20 and the guide rails 19. A further part of the stroke drive apparatus 13 is a wedge mechanism 21 by means of which a situation of the upper tool 11 relative to the lower tool 9 is adjustable.

The lower tool 9 is received so as to be movable along a lower positioning axis 25. This lower positioning axis 25 runs in the direction of the Y axis of the coordinate system of the numerical controller 15. The lower positioning axis 25 is preferably oriented parallel to the upper positioning axis 16. The lower tool 9 can, directly at the lower positioning axis 16, be moved along the positioning axis 25 by means of a motor drive arrangement 26. Alternatively or in addition, the lower tool 9 may also be provided on a stroke drive apparatus 27, which is movable along the lower positioning axis 25 by means of the motor drive arrangement 26. This drive arrangement 26 is preferably configured as a spindle drive arrangement with a spindle 26*a*. The lower stroke drive apparatus 27 may correspond in terms of construction to the upper stroke drive apparatus 13. The motor drive arrangement 26 may likewise correspond to the motor drive arrangement 17.

The lower stroke drive apparatus 27 is likewise displaceably mounted on guide rails 19, which are assigned to lower horizontal frame members 4. Guide shoes 20 of the stroke drive apparatus 27 run on the guide rails 19 such that the connection between the guide rails 19 and guide shoes 20 on the lower tool 9 can also accommodate a load acting in a vertical direction. Accordingly, the stroke drive apparatus 27 is also suspended on the machine frame 2 by means of the guide shoes 20 and the guide rails 19 and so as to be spaced apart from the guide rails 19 and guide shoes 20 of the upper stroke drive apparatus 13. The stroke drive apparatus 27 may also comprise a wedge mechanism 21 by means of which the situation or height of the lower tool 9 along the Z axis is adjustable.

Figure 2:
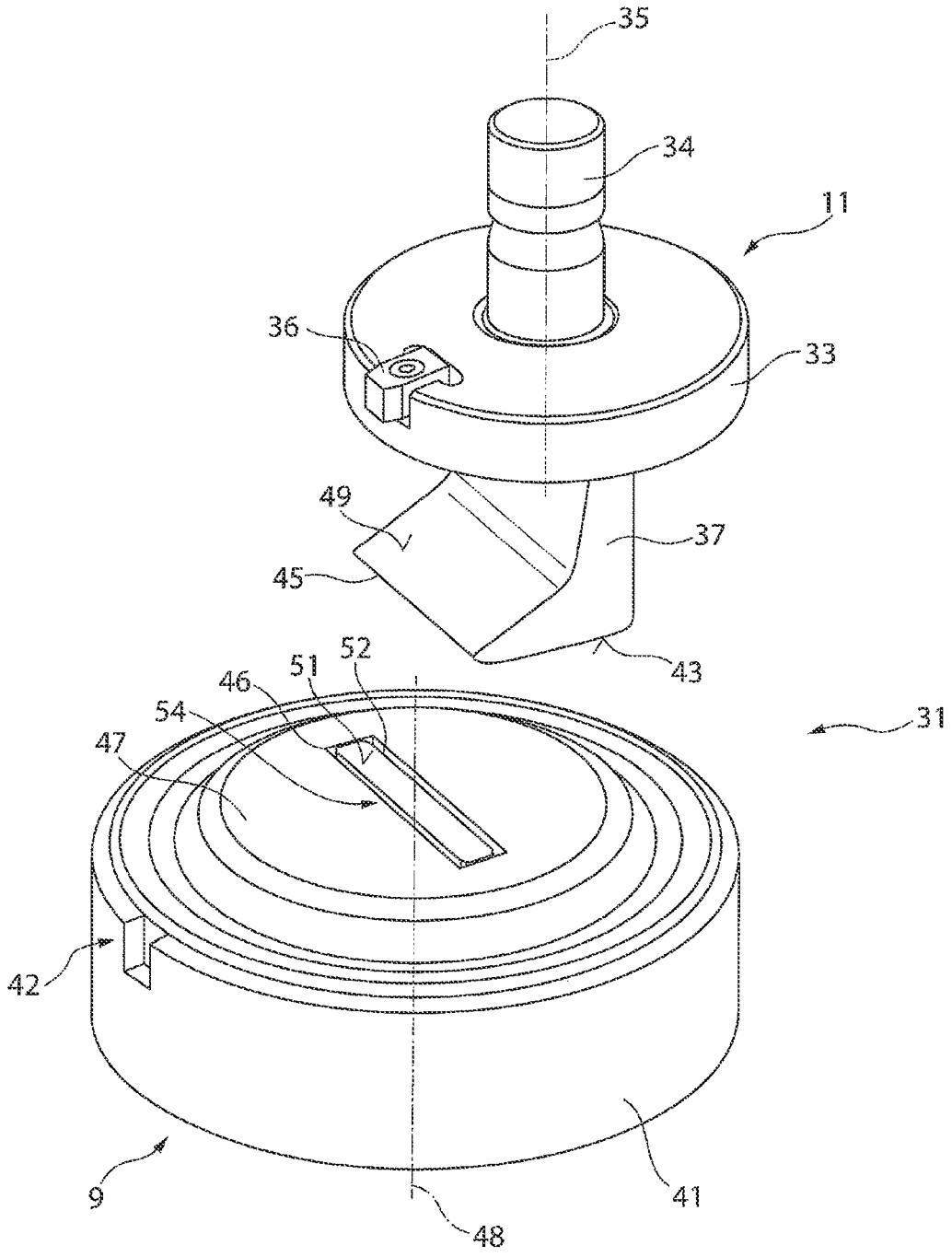
FIG. 2 shows a perspective view of a tool according to a first embodiment.

FIG. 2 is a perspective illustration of a tool 31. The tool 31 is configured as a bending tool with a bending ram, which forms the upper tool 11, and a bending die, which forms the lower tool 9. The upper tool 11 comprises a main body 33 with a clamping shank 34 and an alignment or indexing element 36 or an alignment or indexing wedge. The clamping shank 34 serves to fix the upper tool 11 in the machine-side upper tool receptacle. Here, the orientation of the upper tool 11 or the rotational position of the upper tool 11 is determined by the indexing wedge 36. Here, the upper tool 11 is rotated about a position axis 35. Said position axis 35 forms a longitudinal axis of the clamping shank 34 and preferably also a longitudinal axis of the main body 33. The adoption of the rotational position of the upper tool 11 in the upper tool receptacle results in an orientation of a processing tool 37 of the upper tool.

The lower tool 9 likewise comprises a main body 41, which is suitable for being fixed in the machine-side lower tool receptacle with a defined rotational position, for example by means of at least one indexing element 42. Here, the lower tool 9 is rotatable about a position axis 48. This forms a longitudinal axis or longitudinal central axis of the main body 41.

The lower tool 9 has an opening 46 in a bearing surface 47, which is displaceable in terms of its situation, in particular in a Z direction, in relation to the main body 41. A counterpart bending edge 52 is positioned in said opening 46 of the bearing surface 47, which counterpart bending edge 52 is adjoined by a ram surface 51 which, in an initial position, is provided so as to be preferably flush with respect to the bearing surface 47.

The processing tool 37 on the upper tool 11 comprises one bending edge 45. A further bending edge or a punching edge may be provided opposite said bending edge 45. On the end side, the processing tool 37 comprises a ram surface 43, which transitions into the bending edge 45. An inclined surface 49 extends from the bending edge 45 in the direction of the main body 33 of the upper tool 11. The inclined surface 49 and the ram surface 43 are arranged at an angle of less than 90°. The bending edge 45 is formed at the transition region. The transition region is determined by the magnitude of the radius of the bending edge 45.

Figure 3:
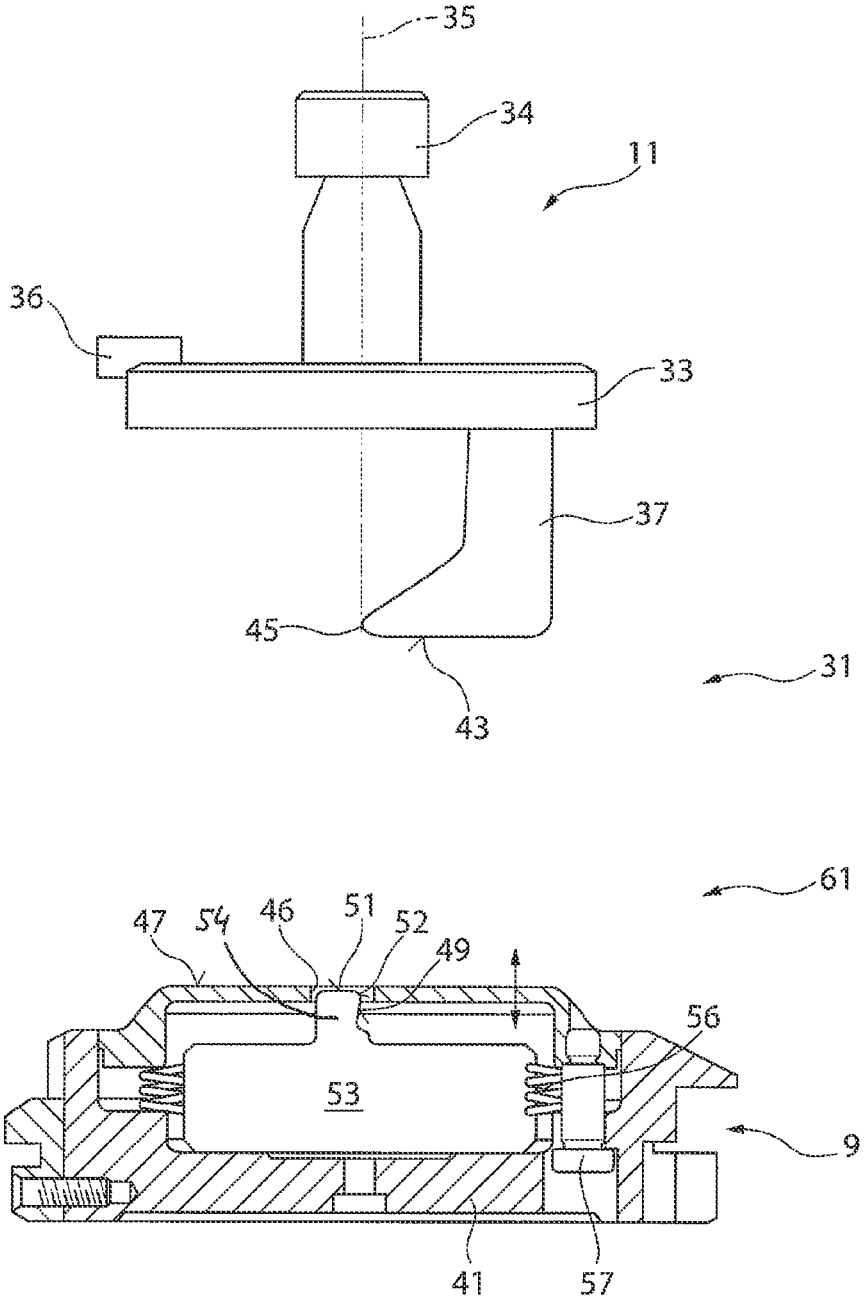
FIG. 3 shows a schematic sectional view of the tool according to FIG. 2.

FIG. 3 illustrates a schematic side view of the tool 31 as per FIG. 2, with the lower tool 9 being illustrated in a sectional arrangement. The main body 41 receives a base body 53 on which the counterpart bending edge 52 is provided. A further counterpart bending edge or counterpart punching edge may be provided opposite said counterpart bending edge 52. The base body 53 with the counterpart bending edge 52, or only the counterpart bending edge 52, may be provided exchangeably on the main body 41. The counterpart bending edge 52 lies between the ram surface 51 and an inclined surface 49, which is directed toward the base body 53.

The bearing surface 47 is received in the main body 41 so as to be displaceable counter to the Z direction. Elastically flexible restoring elements 56 are preferably provided, which, after an exertion of load on the bearing surface 47 as a result of a displacement movement toward the main body 41, transfer said bearing surface 47 back into an initial position, as illustrated in FIG. 3. The bearing surface 47 is guided so as to be movable up and down relative to the main body 41 by means of guide elements 57. For example, only one guide element is illustrated, wherein it is preferable for several to be provided in a manner distributed uniformly over the circumference.

FIGS. 4 to 7 schematically illustrate multiple working steps which illustrate the sequence for a pivoting bending process.

Proceeding from a starting position 61—shown in FIG. 3—in which the upper tool 11 is spaced apart from the lower tool 9, a plate-shaped workpiece 10 is placed with a workpiece part 81 onto the bearing surface 47 and is aligned with the counterpart bending edge 52. The upper tool 11 is thereupon moved toward the lower tool 9. This may also take place in an interchanged manner, or a combined movement may be provided. This relative movement in the Z direction is performed until the upper tool 11 and lower tool 9 are positioned in a first working position 65. See, FIG. 4. In this first working position 65, the bending edge 45 of the upper tool 11 and the counterpart bending edge 52 of the lower tool 9 are spaced apart from one another in the Z direction, wherein the spacing corresponds to the thickness of the workpiece 10. In a first embodiment, the counterpart bending edge and bending edge are spaced apart from one another in the Y direction, wherein said spacing likewise corresponds to the thickness of the workpiece 10. A greater spacing may alternatively also be selected. Proceeding from this first working position 65, a first bending phase as per FIG. 5 can be initiated, wherein this first bending phase is performed only by means of a stroke direction in the Z direction or by means of an already superposed traveling movement in the Z direction and in the Y direction.

Figure 6:
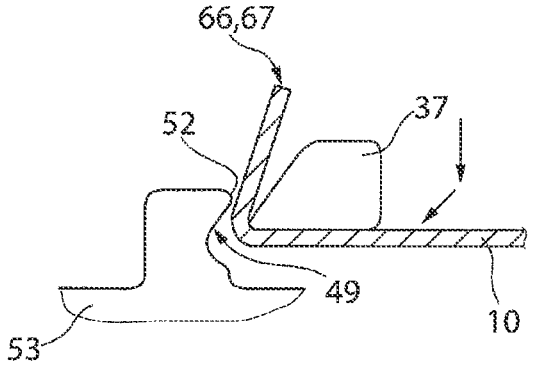

FIG. 6 shows a further intermediate position 66, or end position 67, of the pivoting bending process, in which the bending edge 45 is advanced in the direction of the inclined surface 49 on the tool body 54, with the bending edge 45 and the counterpart bending edge 52 engaging behind one another. In a final working step, the upper tool 11 may be displaced exclusively in the Y direction relative to the lower tool 9 in order to effect overbending of the workpiece part 81 that has been bent at an angle. Displacement movements of the upper tool 11 and lower tool 9 are subsequently effected in the opposite direction.

Figure 4:
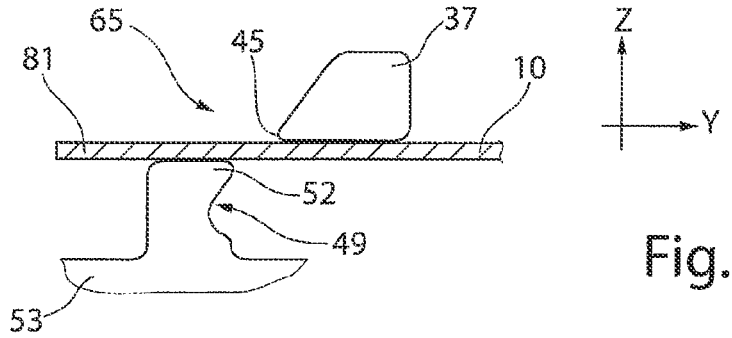
FIGS. 4 to 7 show schematic views of working positions of a pivoting bending process.
Figure 7:
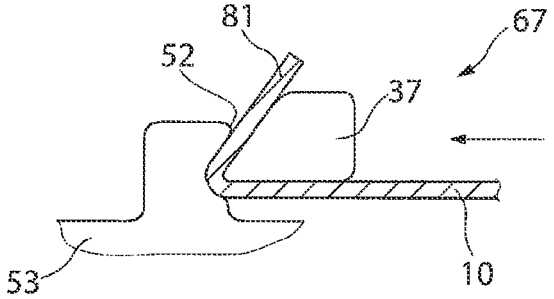

During the transfer of the workpiece 10 from the working position as per FIG. 4 into a position as per FIG. 6 or FIG. 7, a curved path of the upper tool 11 or a curved path of the lower tool 9 or a curved path of the upper tool 11 and 9 is driven in which the displacement movements in the Z direction and Y direction are superposed. This means that the bending edge and the counterpart bending edge 45, 52 are not moved past one another by means of a parallel displacement movement in the Z direction. A curved path is driven in order to move the bending edge 45 and the counterpart bending edge 32 past one another, and subsequently advance these onto the respective inclined surface, if this is necessary in the respective bending step.

Figure 8:
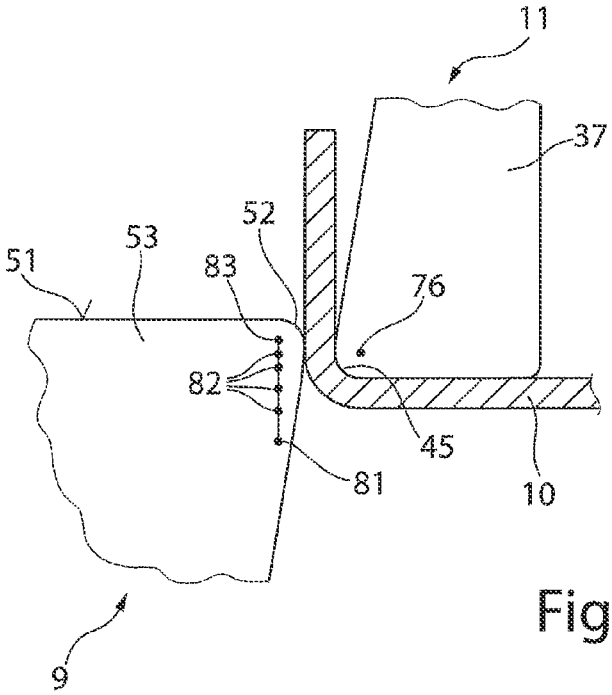
FIG. 8 shows a schematic view of a bending sequence of the bending process as is known from the prior art.

FIG. 8 illustrates a schematic side view of the processing tool 37 of the upper tool 11 with the bending edge 45 and the base body 53 of the lower tool 9 with the counterpart bending edge 52 after a bending process according to the prior art, by means of which, for example, a right-angled bend has been produced on the workpiece 10. To illustrate the course of the bending, a reference point 76 on the processing tool 37 of the upper tool 11 and a starting point 81, intermediate points 82 and an end point 83 on the base body 53 of the lower tool 9 are used as a reference. In an initial position, the workpiece 10 is of planar form. In the initial situation, there is a spacing between the reference point 76 and the starting point 81. The spacing is advantageously set in a manner dependent on the thickness of the workpiece 10 between the ram surface 43 of the processing tool 32 and the ram surface 51 on the base body 53 of the lower tool 9. The upper tool 11 and/or the lower tool 9 is subsequently moved along the intermediate points 82 until the reference point 76 is situated opposite the end point 83.

The starting point 81, the intermediate points 82 and the end point 83 on the lower tool 9 lie in a common straight line, that is to say the upper tool 11 and the lower tool 9 are moved past one another in parallel.

Figure 9:
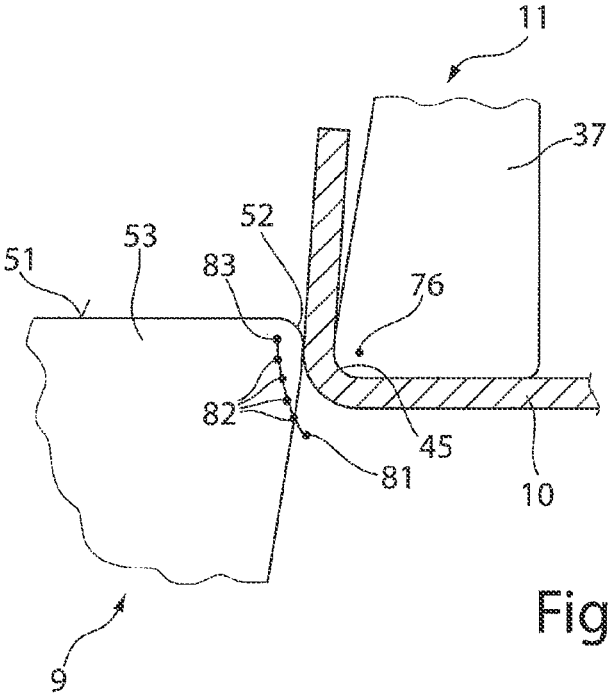
FIG. 9 shows a schematic view of the bending sequence of the bending process according to the invention.

FIG. 9 illustrates a schematic view of the bending sequence according to the invention for the bending process. From the starting point 81 of the lower tool 9 via the intermediate points 82 to the end point 83 of the lower tool 9, it is clear that these points 81, 82 and 83 lie on a curved path or on a curved line. Consequently, the lower tool 9 has been moved in a pivoting bending movement from the starting point 81 via the intermediate points 82 to the end point 83 relative to the reference point 76 of the upper tool 11. The displacement movement as per the illustration in FIG. 9 may also be interchanged, such that the lower tool 9 is static and the upper tool 11 is driven on a curved course. It is also possible for the upper and lower tools 9, 11 to be driven with a relative traveling movement in order to generate this curved course.

Figure 10:
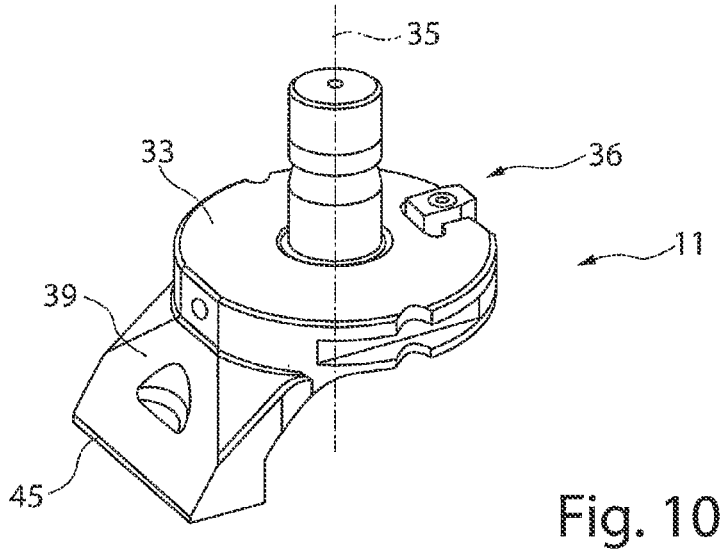
FIG. 10 shows a perspective view of an alternative embodiment of the upper tool in relation to FIG. 2.

FIG. 10 illustrates an alternative embodiment of the upper tool 11 as compared with FIG. 2. This upper tool 11 differs in that the bending edge 45 is formed outside a projection area formed by the main body. The projection area is defined by the area of the main body 33 in the direction of the stroke movement and along the position axis.

Such an upper tool 11 has the advantage that a length of that portion of the workpiece part 81 which is bent at an angle is greater than a spacing between the bending edge 45 and the underside of the main body 33.

Figure 11:
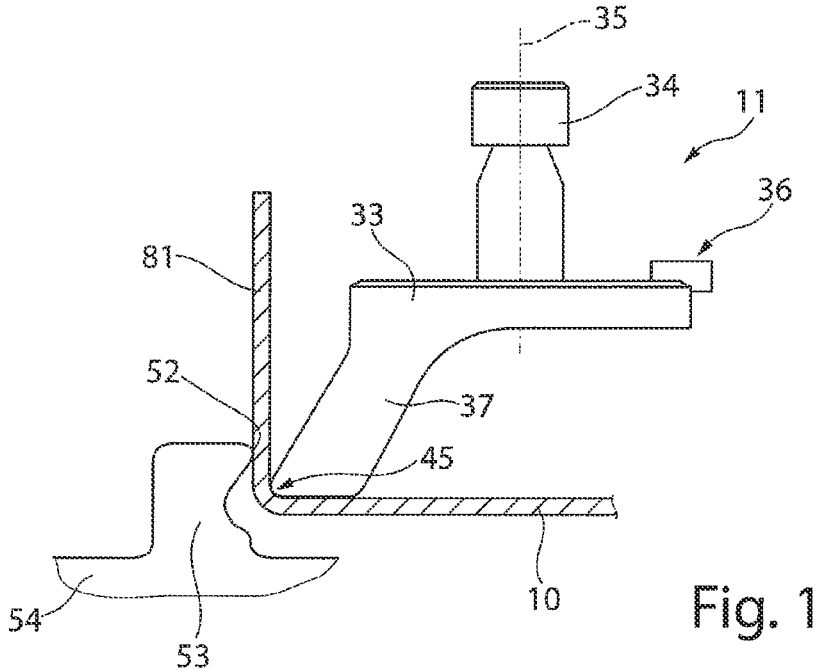
FIG. 11 shows a schematic side view of a working position during the pivoting bending by means of the upper tool as per FIG. 8.

FIG. 11 shows a schematic side view relating to the production of a portion bent at an angle on the workpiece part 81, wherein the length of the workpiece part 81 that has been bent at an angle is greater than the spacing between the bending edge 45 and an underside of the main body 33. The individual working steps for pivoting bending that have been described for example on the basis of FIGS. 4 to 7 can also be performed by means of such an alternative embodiment of the upper tool 11 as per FIG. 10.

Figure 5:
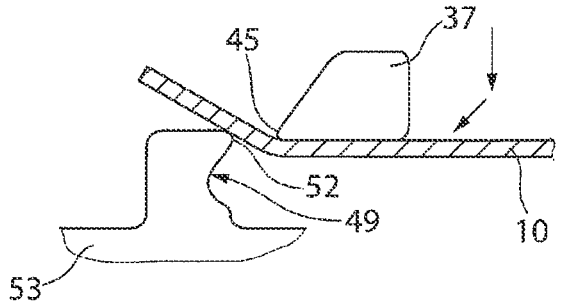
Figure 12:
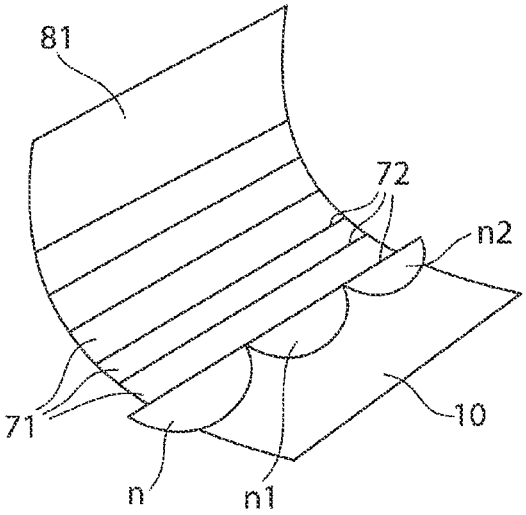
FIG. 12 shows a schematic view regarding the production of a bending edge with a length longer than the bending edge of the tool.

FIG. 12 illustrates a perspective view of a workpiece 10 with a bend which has a radius greater than the bend radius of the bending edge 45 of the upper tool 11 and of the counterpart bending edge 52 of the lower tool 9 as per FIG. 2. Such a radius may be realized by means of multiple successive individual strokes of the upper tool 11 and lower tool 9, wherein the stroke movement ends for example at a position as illustrated in FIG. 5. The workpiece 10 is subsequently offset such that the bending edge 71 lies on the ram surface 51 of the counterpart bending edge 52, in order to subsequently perform a stroke movement again, as illustrated in FIG. 5. This successive processing is also referred to as incremental bending, whereby bends with radii of different size are possible. This is dependent on the spacing of the respectively introduced bending edges 72 and the respective degree of upward bending of such a bend segment 71.

In the exemplary embodiment shown in FIG. 12, the width of the workpiece part 10 is greater than the length of the bending edge 45 and/or of the counterpart bending edge 52. In order to form a bend segment into the plate-shaped workpiece 10, multiple pivoting bending processes are performed in succession along the same bending edge 72 in order to form the bend segment 71. Here, the upper tool 11 may firstly be positioned relative to the workpiece 10 in order to perform the bending step n. The workpiece 10 is subsequently laterally offset in order to perform a stroke n1. The workpiece 10 is subsequently offset further in order to perform the stroke n2. In this way, a bend segment 71 can be formed which has a length greater than the length of the bending edge 45 and/or counterpart bending edge 52 of the tool 31.

These successive working steps n, n1, n2 . . . can be used in the case of bend segments 71 to form several further bend segments in succession. Alternatively, such an implementation of the working steps may for example also be implemented for a 90° angle bend.

Figure 13:
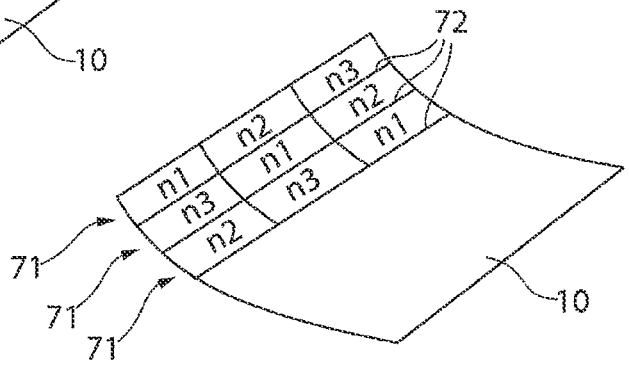
FIG. 13 shows a perspective view for an endless bending operation by means of the tool as per FIG. 2.

FIG. 13 is a further perspective illustration of a workpiece 10 in the case of which multiple bend segments 71 have been produced by incremental pivoting bending. The successive or concatenated working steps preferably differ from one another from the preceding bend segment to the subsequent bend segment 71. For example, the uppermost bend segment 71 may comprise the sequence of working steps n1, n2, n3, wherein, for the subsequent bend segment 71, the working step n1 is offset by one or more working steps in relation to the preceding working step n1. In the case of the third bend segment 71, the first working step n1 may in turn be offset in each case in relation to the working step n1 of the two preceding bend segments 71.

A random selection and arrangement of the individual working steps n1, n2, n3 for each bend segment 71 is also possible, with the premise that two working steps of two successive bend segments 71 are not aligned directly one behind the other.

The introduction of several successive bend segments 71 may be implemented such that a helical contour can also be generated.

Figure 14:
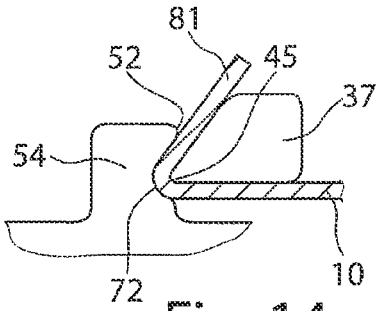
FIGS. 14 to 16 show schematic working steps for the production of a fold on a workpiece.
Figure 15:
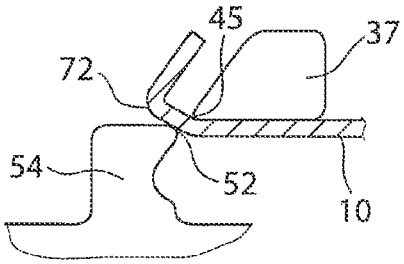
Figure 16:
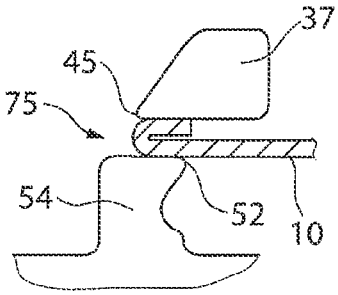

FIGS. 14 to 16 show schematic working steps for the production of a fold 75 on a workpiece 10. For the transformation of the workpiece 10 with the workpiece part 81 that has been bent at an angle as per FIG. 14, the working steps as per FIGS. 4 to 7 have been performed in advance. Subsequently, the upper tool 11 and the lower tool 9 are lifted apart from one another and the workpiece 10 is displaced such that the angled bend of the workpiece 10 is positioned in the region of the ram surface 51 of the tool body 54 on the lower tool 9. A pre-bend is subsequently introduced, as illustrated in FIG. 15. This pre-bend has a spacing to the angled bend, which spacing is shorter than the length of the workpiece part 81. The upper and/or lower tool 11, 9 are subsequently moved apart, and the workpiece part 81 is positioned with the pre-bend on the ram surface 51 of the tool body 54. Subsequently, using the ram surface 43 on the processing tool 37 of the upper tool 11, the workpiece part 81 on the workpiece 10 is bent over and the fold 75 is fully produced.

Figure 17:
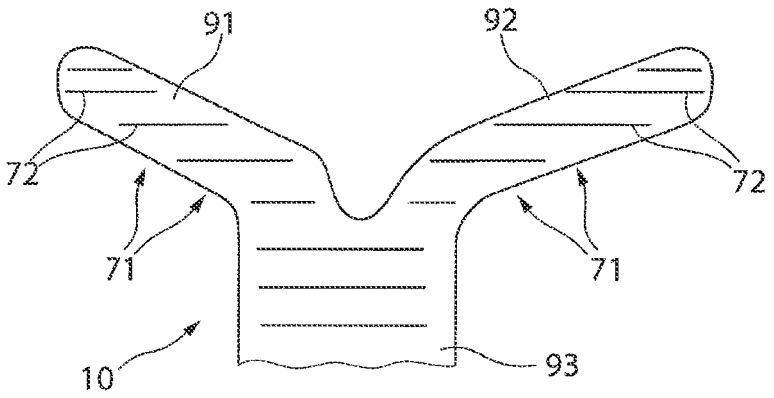
FIG. 17 shows a schematic view of a cut-out workpiece for the production of a helical contour.
Figure 18:
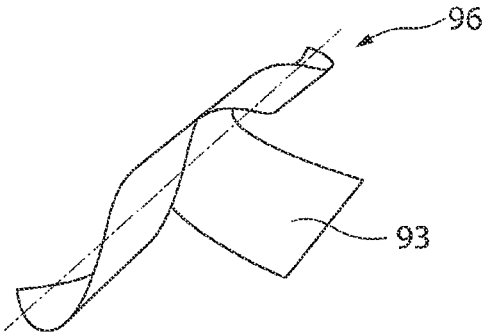
FIG. 18 shows a perspective view of the workpiece with the helical contour.

FIG. 17 illustrates a schematic view of a cut-out workpiece 10 into which a helical contour 96 is to be introduced. In the exemplary workpiece, the cut layout of the workpiece 10 is Y-shaped, such that a first and a second arm 91, 92 are formed which transition into a lug 93. By means of multiple bending steps along the bending edges 72 illustrated by way of example, both the right-hand and the left-hand arm 91, 92 can each have a bend angle applied to them, such that, with the introduction of a multiplicity of bending edges 72, a concatenation of the bend segments 71 is realized, which bend segments 71 form a helical contour 96 which is of greater or lesser diameter in a manner dependent on the angling of the bend segments 71 relative to one another. Such a helical contour 96 is illustrated in FIG. 18. For example, a pin or bolt may be guided along a longitudinal axis of the helical contour 96 such that the lug 93 can be guided pivotably about said longitudinal axis.

The invention claimed is:

1. A tool for processing plate-shaped workpieces, the tool comprising:

an upper tool and a lower tool movably disposed toward one another for processing a workpiece arranged between said upper and lower tools;

said upper tool having a clamping shank and a main body, arranged on a common position axis, and a processing tool mounted to said main body opposite said clamping shank;

said processing tool of said upper tool having at least one bending edge;

said lower tool having a main body with a bearing surface for the workpiece and an opening formed within said bearing surface;

said main body of said lower tool having at least one counterpart bending edge fixedly formed thereon and positioned in said opening formed in said bearing surface;

said bearing surface being displaceable relative to said counterpart bending edge to enable said counterpart bending edge to protrude from said opening formed in said bearing surface;

a stroke drive device configured to move said processing tool of said upper tool along a substantially vertical stroke axis and to impart a substantially vertical force for bending the workpiece clamped between the upper and lower tools; and a drive arrangement for driving one of said processing tool of said upper tool or said main body of said lower tool in a direction substantially orthogonal to the vertical stroke axis and the impart a substantially horizontal force for bending the workpiece clamped between the upper and lower tools.

2. The tool according to claim 1, wherein said bearing surface and a ram surface of said counterpart bending edge are aligned flush with said bearing surface in an initial position of said lower tool.

3. The tool according to claim 1, wherein said bending edge of said upper tool and said counterpart bending edge are of equal length.

4. The tool according to claim 1, wherein said bending edge of said upper tool is shorter than said counterpart bending edge of said lower tool.

5. The tool according to claim 1, wherein said upper tool and said lower tool each has a ram surface extending substantially orthogonal to said common position axis, said bending edge of said upper tool and said counterpart bending edge of said lower tool each have an inclined surface which is inclined with respect to said ram surface, and said inclined surfaces enclose an angle of less than 90° with respect to said ram surface and defining an undercut away from said ram surface in a direction of said common position axis.

6. The tool according to claim 1, wherein said bending edge of said upper tool is aligned within a projection area which is formed perpendicular to said position axis and, as viewed in a stroke direction, through said main body, or wherein said bending edge of said upper tool lies outside said projection area.

7. The tool according to claim 1, configured for processing sheet metal sheets.

8. A method for processing a plate-shaped workpiece, the method comprising:

providing a tool according to claim 1, wherein the processing tool of the upper tool is movable by a stroke drive device along a stroke axis in a Z direction and in a direction of the workpiece for processing by the upper tool and in an opposite direction, and which is positionable along an upper positioning axis running perpendicular to the stroke axis in a Y direction, and moving the upper tool along the upper positioning direction by a drive arrangement;

wherein the lower tool is aligned with the upper tool and is positionable along a lower positioning axis which points in the Y direction and which is oriented perpendicular to the stroke axis of the upper tool, and moving the lower tool along the lower positioning axis by a drive arrangement;

actuating the drive arrangements by a controller for moving the upper and lower tools relative to one another;

positioning a workpiece part of the plate-shaped workpiece relative to the bearing surface of the lower tool;

aligning the bending edge of the upper tool and the counterpart bending edge of the lower tool with one another;

transferring at least one of the bending edge or the counterpart bending edge, by way of a stroke movement in the Z direction, into a first working position in which the bending edge is positioned, as viewed in the Z direction, with a spacing that is at least equal to a thickness of the workpiece, and as viewed in the Y direction, at least with a spacing of the thickness of the workpiece, relative to the counterpart bending edge; and subsequently displacing the bending edge and the counterpart bending edge by moving at least one of the counterpart bending edge or the bending edge past one another by superposition of displacement movements in the Z direction and in the Y direction.

9. The method according to claim 8, wherein the displacing step comprises keeping the counterpart bending edge stationary and driving the bending edge of the upper tool to move along a curved path.

10. The method according to claim 8, wherein the displacing step comprises keeping the bending edge stationary and driving the counterpart bending edge to move along a curved path.

11. The method according to claim 8, which comprises transferring the bending edge of the upper tool and the counterpart bending edge of the lower tool from a first working position into an end position by driving each of the upper tool and the lower tool along a curved path.

12. The method according to claim 8, wherein the displacing step comprises driving displacement movement of the bending edge and/or of the counterpart bending edge a plurality of times in succession for incremental bending, with each bending step forming a bend angle on the workpiece part of less than 90°.

13. The method according to claim 8, which comprises providing the workpiece with a Y shape having two arms which project away from one another, and forming a plurality of successive bending edges in order to form a helical contour.

14. The method according to claim 8, wherein, if a width of the workpiece part is greater than a length of the bending edge or of the counterpart bending edge, introducing multiple bending edges on the workpiece part in succession and along the same bending edge.

15. The method according to claim 14, wherein a sequence of the bending steps along the one bending edge of a subsequent bending segment is configured to differ from the sequence of the bending steps of a preceding bending segment.

16. The method according to claim 8, wherein the plate shaped workpiece is a sheet metal sheet.

* * * * *